US008156870B2

(12) United States Patent
South

(10) Patent No.: US 8,156,870 B2
(45) Date of Patent: Apr. 17, 2012

(54) LIGHTWEIGHT CARTRIDGE CASE

(75) Inventor: Joseph T. South, Bel Air, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 442 days.

(21) Appl. No.: 12/137,989

(22) Filed: Jun. 12, 2008

(65) Prior Publication Data

US 2009/0314178 A1 Dec. 24, 2009

(51) Int. Cl.
*F42B 5/28* (2006.01)

(52) U.S. Cl. ..... 102/469; 102/464

(58) Field of Classification Search ..... 102/464, 102/468, 469, 470, 204, 465, 466, 467, 472
See application file for complete search history.

(56) References Cited

U.S. PATENT DOCUMENTS

| | | | | | |
|---|---|---|---|---|---|
| 3,170,401 | A | | 2/1965 | Johnson et al. | |
| 3,728,967 | A | * | 4/1973 | Hinkle et al. | 102/472 |
| 3,756,156 | A | | 9/1973 | Schuster et al. | |
| 3,771,452 | A | * | 11/1973 | Reed et al. | 102/464 |
| 3,844,216 | A | * | 10/1974 | Jakobs et al. | 102/472 |
| 3,855,900 | A | * | 12/1974 | Barr et al. | 89/159 |
| 3,899,974 | A | * | 8/1975 | Harnau | 102/202.9 |
| 3,977,326 | A | | 8/1976 | Anderson et al. | |
| 4,020,763 | A | | 5/1977 | Iruretagoyena et al. | |
| 4,041,868 | A | * | 8/1977 | Rayle et al. | 102/468 |
| 4,197,801 | A | | 4/1980 | LaFever et al. | |
| 4,682,545 | A | * | 7/1987 | Jett, Jr. | 102/430 |
| 4,738,202 | A | | 4/1988 | Hebert | |
| 5,189,250 | A | | 2/1993 | Shaphyr et al. | |
| 5,515,783 | A | * | 5/1996 | Hesse et al. | 102/206 |
| 5,969,288 | A | | 10/1999 | Baud et al. | |
| 6,131,515 | A | | 10/2000 | Cook et al. | |
| 6,131,519 | A | | 10/2000 | Thiesen et al. | |
| 6,186,094 | B1 | | 2/2001 | Kamdar | |
| 6,272,993 | B1 | | 8/2001 | Cook et al. | |
| 6,487,972 | B1 | | 12/2002 | Cook et al. | |
| 6,748,870 | B2 | | 6/2004 | Heidenreich et al. | |
| 7,069,863 | B2 | | 7/2006 | Olson et al. | |
| 7,213,519 | B2 | | 5/2007 | Wiley et al. | |
| 7,841,279 | B2 | * | 11/2010 | Reynolds et al. | 102/469 |
| 2011/0023742 | A1 | * | 2/2011 | Schaefer et al. | 102/464 |

* cited by examiner

*Primary Examiner* — James Bergin
(74) *Attorney, Agent, or Firm* — Christos S. Kyriakou

(57) ABSTRACT

Disclosed is an ammunition cartridge case that includes a sleeve, a base fixedly attached to the sleeve and a fiber reinforced polymer composite annulus that is at least partially within the base. In certain embodiments, the sleeve and the base are formed partly or entirely from a metal, for example steel or stainless steel. The base has a central aperture that affords for the annulus ring to fit within. The annulus is dimensioned such that it fits securely within the central aperture of the base and has a center aperture wherein a primer can be located. The annulus ring contains a volume of composite fibers ranging from 10 to 90 volume percent. The annulus isolates the primer from the cartridge case and thereby prevents galvanic corrosion between the primer and case. In addition, a metallic foil can be present between the annulus and the cartridge case in order to assure proper securement of the annulus therewithin.

20 Claims, 2 Drawing Sheets

LIGHTWEIGHT CARTRIDGE CASE

GOVERNMENT INTEREST

The invention described herein may be manufactured, used, and licensed by or for the United States Government.

FIELD OF THE INVENTION

This invention relates generally to an ammunition cartridge cases, lightweight metallic ammunition cartridge cases, lightweight metal ammunition cartridge cases and lightweight steel ammunition cartridge cases.

BACKGROUND OF THE INVENTION

Ammunition cartridge cases serve many purposes by providing the ability to combine a projectile, a primer and a propellant into one complete system. This complete system allows for a cartridge to be placed within a weapon and fired such that the projectile exits a barrel of the weapon at a high rate of speed in an attempt to strike a desired target. During combustion of the cartridge, the cartridge case obturates a chamber of the weapon as a result of pressure exerted thereon by gunpowder combustion gases while providing a finite volume for the controlled ignition of the gunpowder to take place. After firing of the ammunition, the cartridge case has served its purpose and is typically discarded, recycled, or reloaded.

While primer and gunpowder serve critical roles in conveying the projectile toward a desired target, the cartridge packaging does not directly progress the projectile toward the target and as such cartridge modification would minimally affect the overall system performance. Thus, if a lightweight cartridge case could be engineered, such that the system provided the same functionality, but with a lighter weight, an overall system performance increase could be obtained. For example, a soldier or individual could carry additional ammunition at the same basic load or carry an equal amount of ammunition with a reduced weight burden. Similar benefits could be demonstrated on larger mobile platforms, such as aircraft, where weight-limiting factors also exist.

Small caliber ammunition cartridge cases typically consist of brass that has been formed through a series of cold working and annealing steps. This process results in a graded microstructure that produces higher hardness and strength near the base of the cartridge and a graded hardness and strength along the length of the sleeve sidewalls. The base of the cartridge is substantially thicker than the remainder of the cartridge, as it serves to hold the primer in place, as well as allow for extraction of the cartridge case from the weapon after firing. Thus the base area possesses the highest mass of the entire cartridge. Weight savings of the ammunition can be obtained by substituting steel for brass. However, to achieve larger reductions in weight for the ammunition, additional changes are needed. Therefore, an ammunition cartridge case with greater weight savings compared to traditional brass cartridge cases is desired.

SUMMARY OF THE INVENTION

Disclosed is an ammunition cartridge case that includes a sleeve, a base fixedly attached to the sleeve and a fiber reinforced polymer composite annulus at least partially within the base. The base has a central aperture that affords for the annulus to fit within. In certain desirable embodiments, the sleeve and the base are made of a metal or a metallic material.

In certain more desirable embodiments, the sleeve and the base are made of steel. In still more desirable embodiments, the sleeve and the base are made of a stainless steel.

In some instances, the steel base is integral with the steel sleeve and the steel base has an extractor groove. The fiber reinforced polymer composite annulus is dimensioned such that it can be placed securely within the central aperture of the steel base and has a center aperture wherein a primer can be located. The annulus ring may contain a volume of composite fibers ranging from 10 to 90 volume percent. The annulus isolates the primer from the steel cartridge case and thereby prevents galvanic corrosion between the primer and case. In addition, a metallic foil can be present between the annulus and the steel cartridge case in order to assure proper securement of the annulus therewithin.

DETAILED DESCRIPTION OF THE PREFERRED EMBODIMENTS

The present invention is a lightweight cartridge case having a base with a fiber reinforced polymer composite annul us therewithin. As such, the present invention has utility as a cartridge case for ammunition.

In the exemplary embodiment described and illustrated herein, the lightweight cartridge case includes a steel sleeve and a steel base. However, it is suggested that the sleeve and/or base can be formed entirely or partially from another metal or another material for example a metallic material. In some instances, the steel base is integral with the steel sleeve and the steel case is formed as one unit. The steel base has a central aperture. Within the central aperture, a fiber reinforced polymer composite annulus is located, the annulus operable to have a primer placed within and to withstand the pressures generated from the firing of the cartridge. An overall weight reduction is obtained based on the lower density of the apertured steel base and fiber reinforced polymer composite annulus relative to a conventional cartridge case. Extending from the steel base and to the steel sleeve is a flash hole that affords for the ignition of a propellant that is within the steel sleeve after the primer has been detonated. The steel sleeve is lighter than a comparable brass sleeve and the fiber reinforced polymer composite annulus is lighter than the steel that would be present if the annulus were not used. As such, a weight savings in a small caliber ammunition cartridge case is afforded relative to a conventional cartridge case of like caliber and powder capacity.

Figure 1:
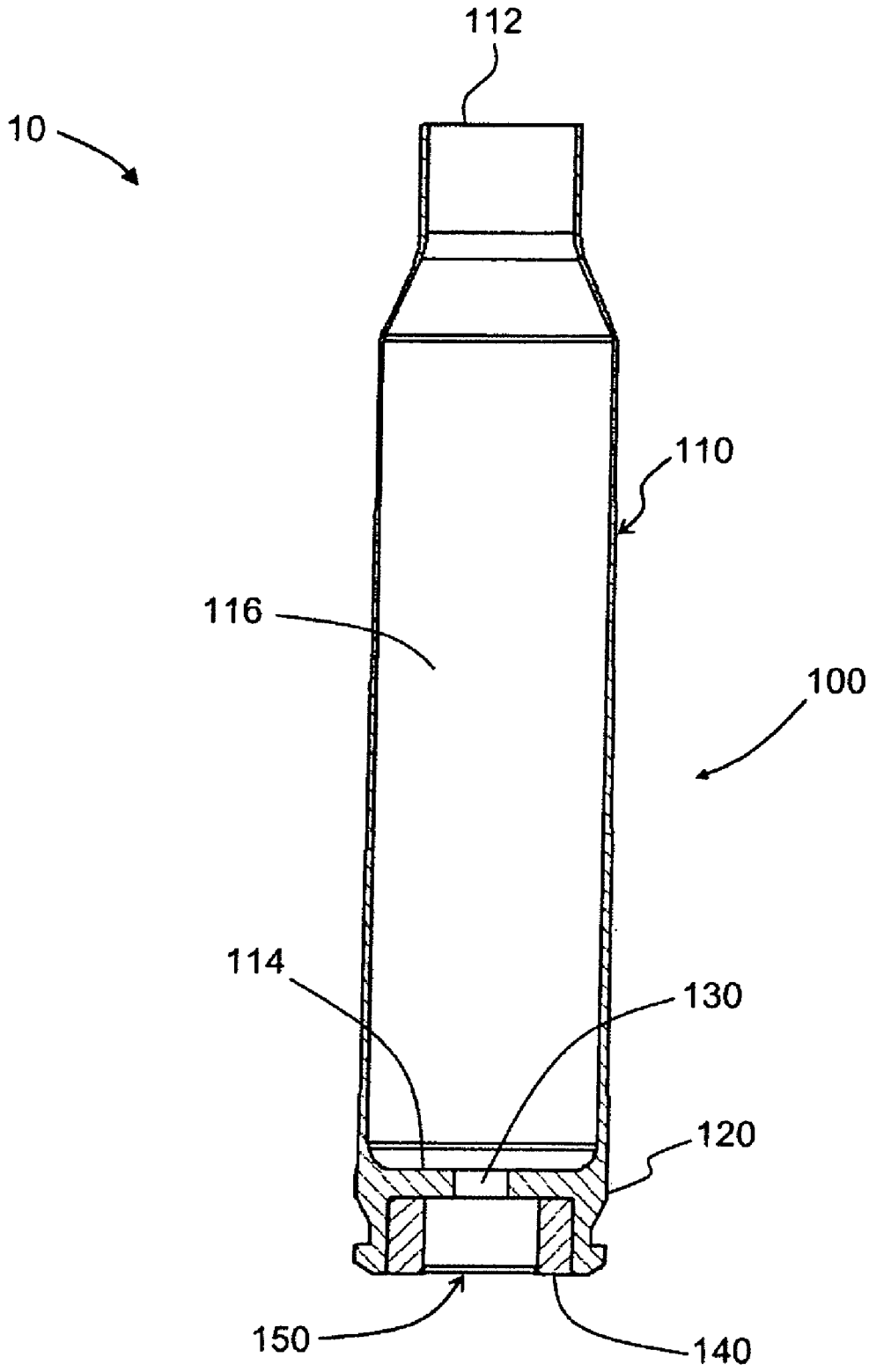
FIG. 1 is a longitudinal cross-sectional view of an embodiment of an inventive cartridge case where all longitudinal cross-sectional views are symmetric.

Referring now to FIG. 1, there is shown generally in FIG. 1 an embodiment of an inventive steel cartridge case at reference numeral 10. The cartridge case 10 has a steel body 100, a steel sleeve 110 terminating in a mouth end 112 and a base end 114. The mouth end 112 is operable to accept and attach a projectile (not shown) to the body 100. An interior volume 116 is defined between the mouth end 112 and the base end 114. The volume 116 affords a locale for gunpowder to be located and stored.

Joined to the base end 114 of the steel sleeve 110 is a steel base 120. At least partially within the base 120 of the steel body 100 is a fiber reinforced polymer composite annulus 140. At least partially within the annulus 140 is a primer 150. For illustrative purposes, the primer 150 is depicted as a shell empty of ignition powder.

The case body 100 can be formed from a single piece of steel through a series of cold working and annealing steps. In the alternative, the steel sleeve 110 can be formed separate from the steel base 120 and joined by conventional steel forming techniques such as induction welding and the like, and subsequently polished as needed. Alternatively, an inventive case body 100 is readily formed by machining a steel boule.

Figure 2:
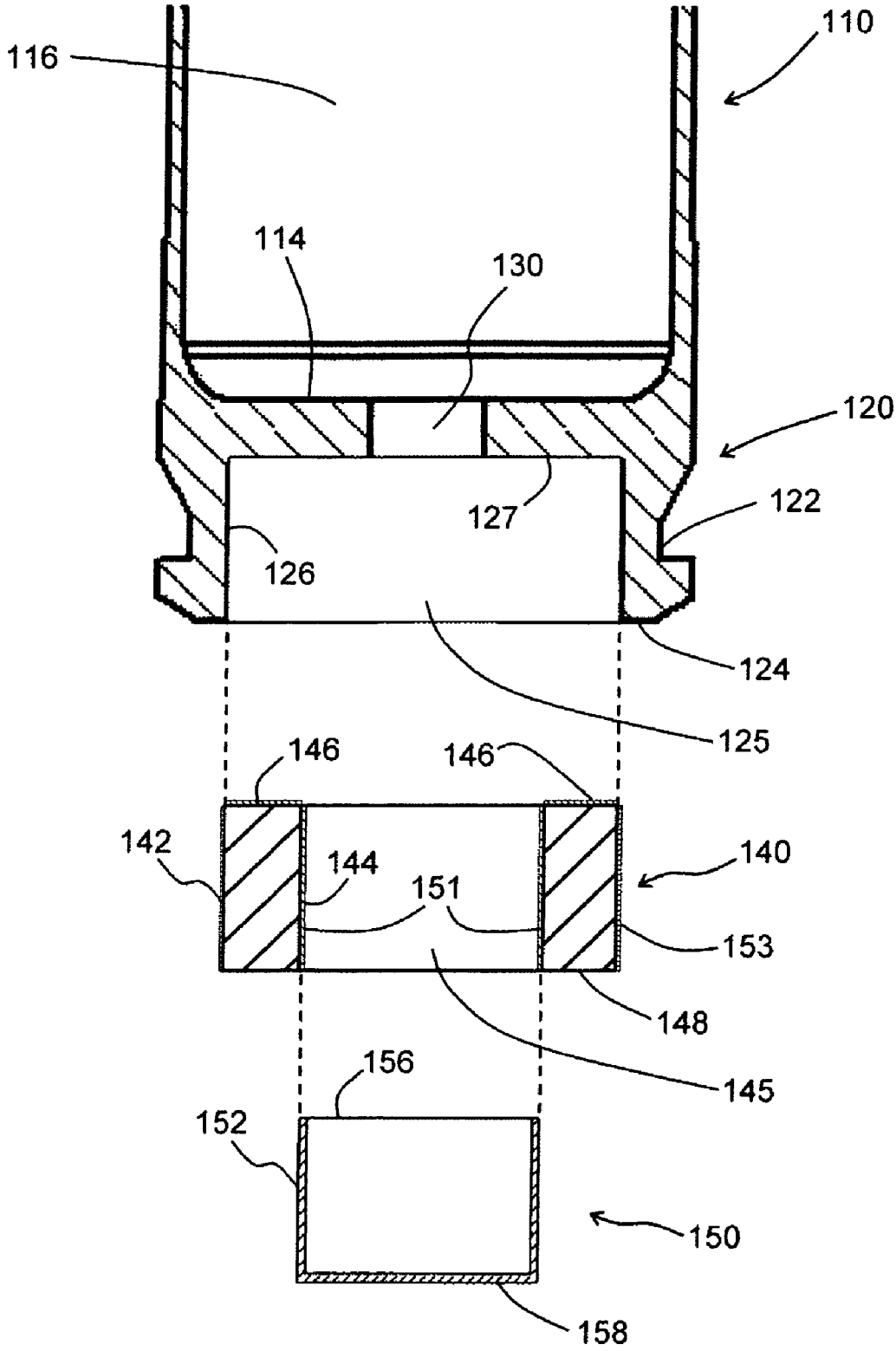
FIG. 2 is an exploded longitudinal cross-sectional view of the base region shown in FIG. 1.

An exploded view of the base 120 region is shown in FIG. 2. The base 120 optionally includes an extraction groove 122 which is illustrated for exemplary purposes as a depression or groove around the circumference of the base 120. The extraction groove 122 affords a surface for an autoloader extractor claw to grab the cartridge case 10 and pull it from a firing chamber of a weapon (not shown).

Within the base 120 is a central aperture 125, said aperture having a sidewall 126 and a top wall 127. Extending from the central aperture 125 to the interior volume 116 is a flash hole 130. The central aperture 125 of the base 120 is a void in the steel base 120 and thus affords a net reduction in weight for the steel cartridge case 10 by an amount equal to the difference in weight between the annulus 140 and a like volume of base metal.

The annulus 140 has an outer sidewall 142 and an inner sidewall 144. Between the outer sidewall 142 and the inner sidewall 144 is a fiber-reinforced polymer composite. A top end 146 and a bottom end 148 also bound the fiber-reinforced polymer composite. Preferably the outer sidewall 142 is complementary to sidewall 126. More preferably, top end 146 sits flush against top wall 127 so as to resist combustion gas escape therebetween. Fibers within the annulus 140 can have a variety of orientations, such as hoop oriented fiber orientations and axially oriented fiber orientations and combinations thereof. In certain embodiments, from about 50 to about 80 number percent of the fibers have a hoop orientation. In other embodiments, from about 20 to about 60 number percent of the fibers have an axial orientation.

The fibers can be made from a variety of materials that provide strength to the annulus 140, illustratively including, but not limited to: glass; carbon; polymeric materials illustratively including but not limited to, poly-paraphenylene terephthalamide an example of which is sold under the tradename KEVLAR, polymetaphenylene isophtalamide an example of which is sold under the tradename NOMEX, poly-paraphenylene terephthalamide copolymer an example of which is sold under the tradename TECHNORA, polyamide imide an example of which is sold under the tradename KERMEL, copolyimide an example of which is sold under the tradename P84, polyurethane, polyepoxy, poly vinyl ester), polyphenol, polybenzoxazole, polyamides, polyethylene, ultra high molecular weight polyethylene for example polyethylenes having a molecular weight of greater than 1 million, and M5 synthetic fibers. In some instances, carbon fibers are used and are selected from short chopped carbon fibers, aligned continuous carbon fibers, woven carbon fibers, non-woven carbon fibers, and combinations thereof. Suggested diameters for fibers within the annulus 140 range from about 0.5 to about 100 microns. In some embodiments, the average fiber diameter ranges from about 1 to about 50 microns, and in other embodiments, the average fiber diameter ranges from about 5 to about 10 microns.

A polymer within the annulus 140 provides a matrix and can be selected from thermoplastic polymers and/or thermosetting polymers. In some instances, the annulus 140 is made by pressure-assisted infusion of a flowable polymer into a dry fabric. It is appreciated that pressure-assisted infusion includes vacuum-assisted infusion. In addition, the pressure-assistance or vacuum-assistance infusion can be applied to assist a flowable thermosetting resin, polymerizable thermoplastic prepolymer, or dissolved thermoplastic polymers into the dry fabric. The relative proportion of a chosen polymer as the matrix for the annulus 140 ranges between about 10 volume percent to about 50 volume percent. In some instances, the polymer within the annulus 140 ranges from about 15 volume percent to about 40 volume percent. It is appreciated that an annulus with a lower proportion of polymer provides a harder object whereas a higher proportion of polymer provides a member that is more shapeable. It is also appreciated that the balance of the annulus 140 includes one or more of the fibers mentioned above and/or any other type of fiber that can provide strength to the annulus 140.

The annulus 140 is also readily made from thin sheets containing fiber which are impregnated with a polymer. The relative orientation of the fiber is optionally set within the thin sheet before the polymer is impregnated with a polymer(s) and once secured, the annulus can be cut out of the sheet. Naturally, other methods of manufacture are possible so long as an annulus member having the required chemical, mechanical and physical properties is obtained.

The annulus 140 is dimensioned such that the distance between the top end 146 and the bottom end 148 is generally equivalent to the distance between the top wall 127 of the central aperture 125 and a head end 124 of the base 120. In this manner, the annulus 140 fits generally flush with the head end 124 of the base 120. The annulus 140 is also dimensioned such that the inner sidewall 144 defines a diameter that affords for the primer 150 to be located therewithin. The annulus 140 is sealed in aperture 125 through friction fit or optionally through resort to a layer of an adhesive 151 and/or optionally a layer of metal foil 153. Adhesive may be applied between side wall 126 of the base and side wall 142 of the annulus.

The primer 150 has a sidewall 152, a top end 156 and a strike end 158. The primer 150 is placed within the annulus 140 with the sidewall 152 at least partially in contact with the inner sidewall 144. In some instances, the aperture 145 of the annulus 140 is dimensioned such that the primer 150 can be press fit therein. Optionally an adhesive 151 serves to secure the primer 150 into the annulus 140. A distance between the top end 156 and the strike head 158 of the primer 150 is generally equivalent to the distance between the top end 146 and the bottom end 148 of the annulus 140. In this manner, the primer 150 with the strike head 158 is generally flush with the head end 124 of the base 120.

Advantageously, the annulus 140 being made from a fiber reinforced polymer composite affords for the isolation of the primer 150 from the steel body 100. The isolation of the primer 150 from the steel case 100 advantageously affords for the prevention of galvanic corrosion between a primer having a dissimilar composition such as a copper or copper alloy surface and the steel case 100. A metallic foil 153 is optionally located between the annulus 140 and the base 120. A metallic foil may be located therebetween in order to provide improved adhesion of the annulus 140 inside the base 120, the foil 153 being made from any metallic material known to those skilled in the art, illustratively including, but not limited to, copper, copper alloys, stainless steel, aluminum, aluminum alloys, titanium and titanium alloys.

The foregoing drawing, discussion and description are illustrative of specific embodiments of the present invention, but they are not meant to be limitations upon the practice thereof. Numerous modifications and variations of the invention will be readily apparent to those of skill in the art in view of the teaching presented herein. It is the following claims, including all equivalents, which define the scope of the invention.

I claim:

1. A cartridge case, comprising:

a sleeve, said sleeve having a mouth end and a base end, said mouth end operable to accept a projectile;

a base fixedly joined to said base end of said sleeve, said base having a central aperture; and a fiber reinforced polymer composite annulus at least partially disposed within said central aperture, said fiber reinforced polymer composite annulus defined by an outer sidewall, an inner sidewall, a top end, a bottom end and a central aperture that affords a location for a primer to be located therewithin.

2. The cartridge case of claim 1, wherein said sleeve is a metallic sleeve or a metal sleeve and said base is a metallic base or a metal base.

3. The cartridge case of claim 1, wherein said sleeve is a steel sleeve and said base is a steel base.

4. The cartridge case of claim 1, wherein, said annulus has a center aperture and further comprising a primer at least partially within said center aperture of said annulus ring.

5. The cartridge case of claim 4, wherein said annulus isolates said primer from said cartridge case.

6. The cartridge case of claim 4, further comprising a metallic foil between said annulus and said base.

7. The cartridge case of claim 6, wherein said metallic foil is selected from a group consisting of copper foil, stainless steel foil, aluminum foil, aluminum alloy foil, titanium foil and titanium foil.

8. The cartridge case of claim 1, wherein said annulus contains a volume of composite fibers ranging from about 10 to about 90 percent.

9. The cartridge case of claim 8, wherein said composite fibers are glass fibers.

10. The cartridge case of claim 8, wherein said composite fibers are polymeric fibers.

11. The cartridge case of claim 8, wherein said composite fibers are selected from the group consisting of polyurethane, polyepoxy, poly(vinyl ester), polyphenol polybenzoxazole, polyamide, polyethylene, ultra high molecular weight polyethylene, M5 synthetic, poly-paraphenylene terephthalamide, polymetaphenylene isophtalamide, polyamide imide, copolyimide, and combinations thereof.

12. The cartridge case of claim 8, wherein said composite fibers have an orientation selected from the group consisting of hoop, axial, and a combination thereof.

13. The cartridge case of claim 8, wherein said composite fibers are carbon fibers.

14. The cartridge case of claim 13, wherein said carbon fibers are selected from the group consisting of short chopped carbon fibers, aligned continuous carbon fibers, woven carbon fibers, non-woven carbon fibers and combinations thereof.

15. The cartridge case of claim 1, wherein said annulus has a matrix made from a plastic, said plastic selected from the group consisting of thermoplastic polymers and thermosetting polymers.

16. The cartridge case of claim 1, wherein said annulus is made from a composite formed by pressure-assisted infusion of a flowable polymer into a dry fabric.

17. A cartridge case, comprising:

a metallic sleeve, said sleeve having a mouth end and a base end, said mouth end operable to accept a projectile;

a metallic base extending from and integral with said base end of said sleeve, said base having a central aperture;

a fiber reinforced polymer composite annulus at least partially disposed within said central aperture, said annulus having an outer sidewall, an inner sidewall, a top end, a bottom end and a center aperture; and a primer at least partially within said center aperture of said annulus.

18. The cartridge case of claim 17 further comprising an adhesive intermediate between said annulus and at least one of said metallic base and said primer.

19. The cartridge case of claim 17, wherein said annulus contains a volume of composite fibers ranging from about 10 to about 90 percent.

20. A cartridge case, comprising:

a steel sleeve, said sleeve having a mouth end and a base end, said mouth end operable to accept a projectile;

a steel base extending from and integral with said base end of said sleeve, said base having a central aperture and an extraction groove;

a fiber reinforced polymer composite annulus at least partially within said central aperture, said annulus having an outer sidewall, an inner sidewall, a top end, a bottom end and a center aperture wherein the fiber reinforced polymer composite annulus comprises a volume of composite fibers ranging from about 10 to about 90 percent; and a primer at least partially within said center aperture of said annulus, said primer isolated from said steel base by said annulus.

* * * * *